United States Patent [19]

Crawford, III et al.

[11] 4,448,267

[45] May 15, 1984

[54] DOOR DRILLING KELLY

[76] Inventors: Russell C. Crawford, III; George M. Crawford; Russell C. Crawford, Jr., all of P.O. Box 27054, Memphis, Tenn. 38127

[21] Appl. No.: 412,605

[22] Filed: Aug. 30, 1982

[51] Int. Cl.[3] ..... E21B 17/00

[52] U.S. Cl. ..... 175/218; 175/213; 175/320

[58] Field of Search ..... 175/324, 218, 213, 215, 175/65, 320, 217; 137/119; 405/36

[56] References Cited

U.S. PATENT DOCUMENTS 1,918,096 7/1933 Greve ..... 175/320 X

*Primary Examiner*—Stephen J. Novosad
*Assistant Examiner*—Michael Starinsky

[57] ABSTRACT

This is a device for reverse flow drilling of water wells, elevator ram holes and other holes. It is constructed of a hollow metal tubing with doors to allow for the discharge of excavated materials. In operation the Kelly (drill stem) is rotated into the ground and an airlift is used to bring cuttings into the drill stem and then out the doors. The doors are usually hand opened and hand closed and are locked by turning the door locks with a wrench or other tool. As the Kelly is rotated into the ground each door is opened for discharge and then closed before submergence into the drilling fluid.

1 Claim, 15 Drawing Figures

DOOR DRILLING KELLY

BACKGROUND

Many methods of conveying the cuttings from the bottom of reverse flow bored holes are currently in use. One method uses a system of jets to move the cuttings through the kelly and out a discharge hose to the mud pit. Another methods allows the cuttings to be discharged directly out of the kelly without a hose.

SUMMARY OF INVENTION

This invention relates to the uninterrupted discharge of drill cuttings through the various lateral discharge ports on a reverse flow kelly. Each port is located along the vertical axis of the kelly at convenient distances apart, so that as the kelly rotates and advances, the doors of ports are manipulated to control the discharge velocity, quantity, and quality. With careful manipulation, the total energy input requirement for advancing a borehole by the reverse flow method may be substantially reduced.

DETAILED DESCRIPTION

Figure 1:
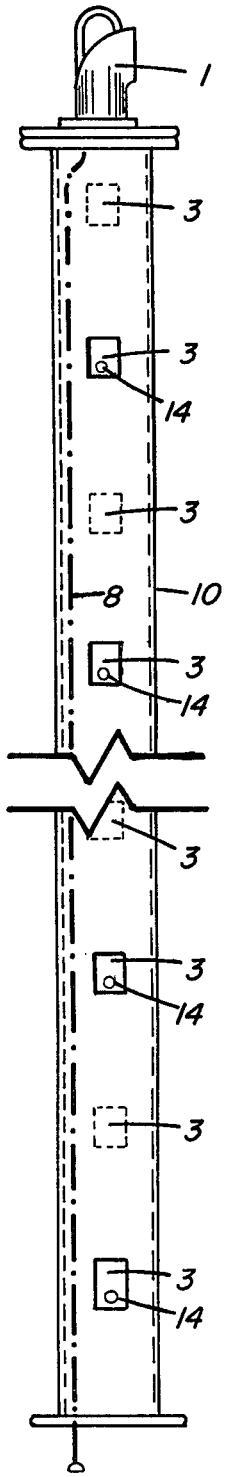
FIG. 1 side view of door kelly.
Figure 2:
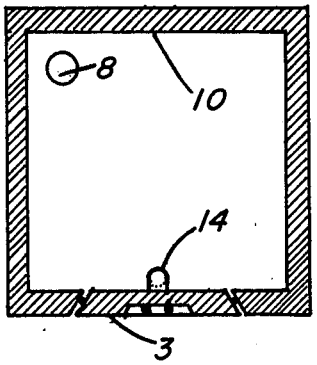
FIG. 2 cross section of square door kelly.
Figure 3:
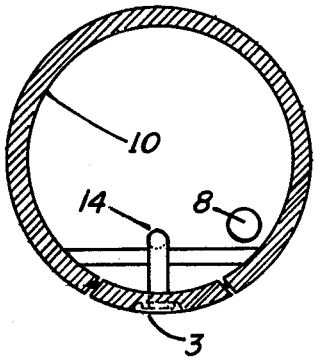
FIG. 3 cross section of round door kelly.
Figure 4:
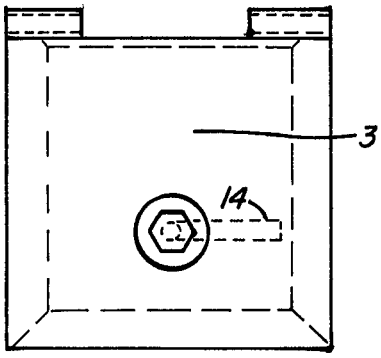
FIG. 4 frontal view of typical door.
Figure 5:
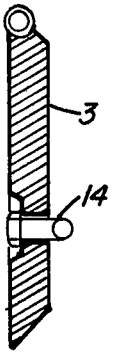
FIG. 5 cross section of typical door.
Figure 6:
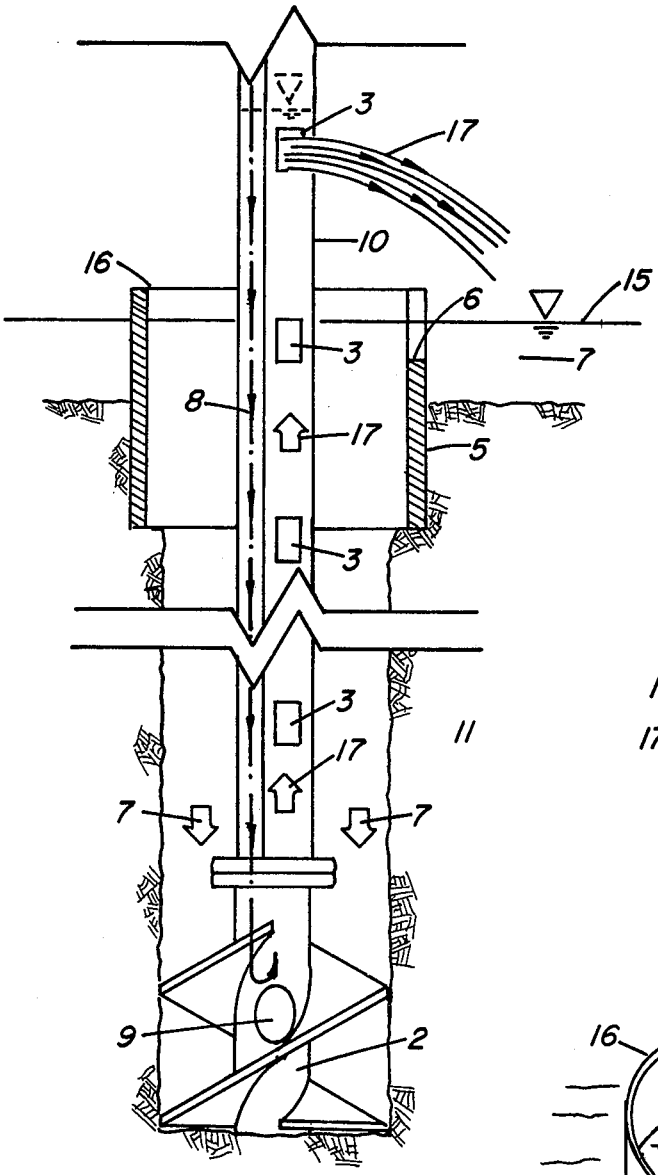
FIG. 6 partial auxillary view of door kelly in operation.
Figure 7:
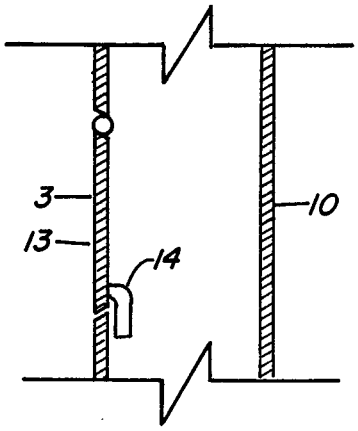
FIG. 7 cross section of door kelly with hinged door closed.
Figure 8:
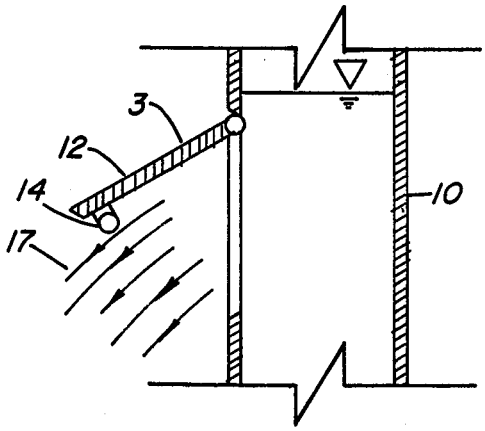
FIG. 8 cross section of door kelly with hinged door open.
Figure 9:
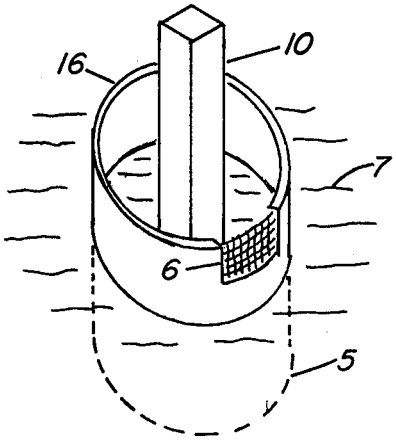
FIG. 9 isometric view of casing with weir.
Figure 10:
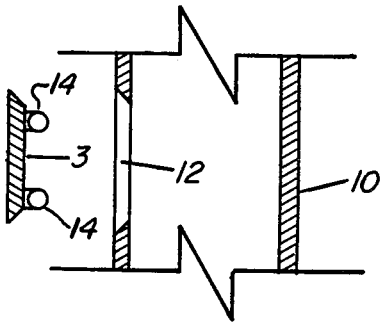
FIG. 10 cross section of door kelly with removable door open.
Figure 11:
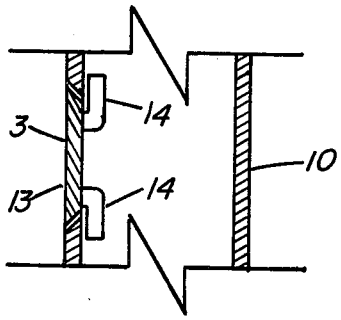
FIG. 11 cross section of door kelly with removable door closed.
Figure 12:
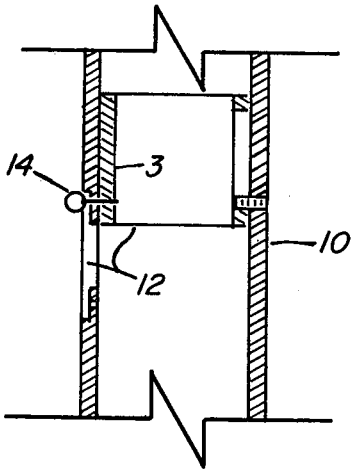
FIG. 12 cross section of door kelly with sliding door open.
Figure 13:
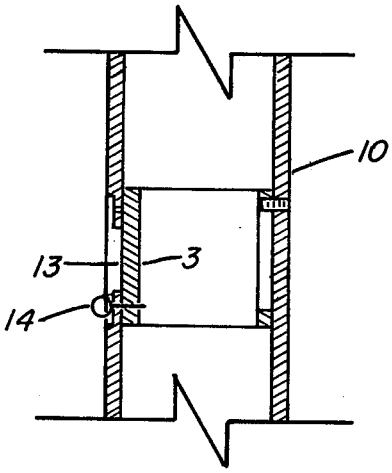
FIG. 13 cross section of door kelly with sliding door closed.
Figure 14:
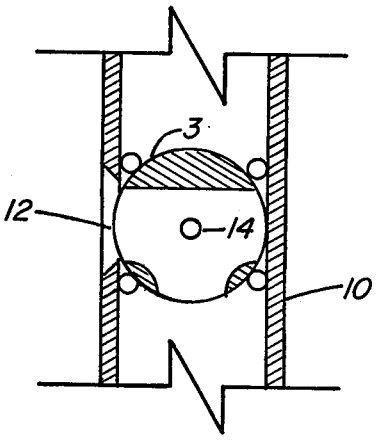
FIG. 14 cross section of door kelly with globe door open.
Figure 15:
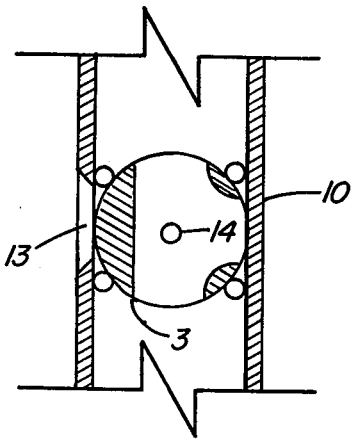
FIG. 15 cross section of door kelly with globe door closed.

A standard drilling kelly, 10, is adapted for reverse circulation drilling by the addition of doors, 3, with mechanical latches, 14, at regular spaces, to allow for the discharge of cuttings, 17. In operation, the kelly, 10, is fitted with a lifting bale, 1, and a cutting bit, 2. The doors are then placed in position 13, closed and latched.

A borehole, 4, is predrilled to a desirable depth, fitted with a casing, 5, and flooded with drilling fluids, 7. A screened weir, 6, is fitted to the casing 5, to control the introduction of drilling fluids, 7, and to restrain solids and trash from entering the borehole.

The prepared kelly, 10, is then placed into the borehole, 4, and a door, 3, above the top of casing, 5, is readied for drilling by disengaging latch, 14. Then a fluid lifting means, 8, such as a conventional air lift reverse flow system, is applied to the inlet, 9, or cutting bit, 2, such that drilling fluid and cuttings, 17, are caused to circulate up the hollow drilling kelly, 10, to the unlatched door, 3, forcing it by fluid pressure into the open position 12. Drilling fluid and cuttings, 17, are then discharged from kelly, 10, outside of casing, 5, and restrained from re-entering. Torque is then applied to the kelly, 10, twisting the cutting bit, 2, such that the submerged earth, 11, is loosened and lifted to inlet, 9, of the bit, 2, drawn within the kelly, 10, and transmitted to the unlatched door, 3. Cuttings, 17, are discharged radially as the kelly, 10, bit, 2, rotate and advance the borehole, 4. Whenever the kelly, 10, has advanced the borehole, 4, such that the unlatched door, 3, approaches the level of the drilling fluid surface, 15, or the top of casing, 16, the fluid lifting means, 8, is interrupted, said door, 3, is placed in position 13, by removing fluid pressure and then the door, 3, is locked by turning latch 14, with a wrench and the next door is unlatched such that upon continuence of fluid lifting means, 8, the unlatched door, 3, will assume position 12. This procedure continues until borehole, 4, achieves the proper penetration of the earth. Then kelly, 10, is stopped from rotation, fluid lifting means, 8, is discontinued, doors, 3, are placed in position 13, closed and latched, and tools are removed from the borehole.

We claim:

1. A hollow drilling kelly for reverse circulation drilling comprising a hollow metal tubing having a series of openings longitudely spaced therealong, each of said openings having door means normally closing said openings to allow retention of fluids within said kelly and means associated with said doors for allowing said doors to be sequentially opened and closed for discharging fluid from and retaining fluids within said kelly, respectively.

* * * * *